US005860296A

United States Patent [19]

Mostello

[11] Patent Number: 5,860,296

[45] Date of Patent: Jan. 19, 1999

[54] METHOD AND APPARATUS FOR SEPARATING AIR

[75] Inventor: Robert A. Mostello, Somerville, N.J.

[73] Assignee: The BOC Group, Inc., New Providence, N.J.

[21] Appl. No.: 107,572

[22] Filed: Jun. 30, 1998

[51] Int. Cl.[6] ..... F25J 3/04

[52] U.S. Cl. ..... 62/643; 62/648; 62/903; 62/910; 62/5

[58] Field of Search ..... 62/5, 643, 648, 62/903, 910

[56] References Cited

U.S. PATENT DOCUMENTS

| | | | |
|---|---|---|---|
| 3,775,988 | 12/1973 | Fekete | 62/910 X |
| 4,531,371 | 7/1985 | Voronin et al. | 62/640 X |
| 5,305,610 | 4/1994 | Bennett et al. | 62/5 |
| 5,540,058 | 7/1996 | Yi et al. | 62/641 |

*Primary Examiner*—Christopher B. Kilner

*Attorney, Agent, or Firm*—David M. Rosenblum; Salvatore P. Pace

[57] ABSTRACT

A method and apparatus for separating air in which a compressed and purified air stream is cooled in a main heat exchanger. Thereafter, the compressed and purified air is separated in a distillation column system to produce product streams. The product streams warm within the main heat exchanger by indirectly exchanging heat with the compressed and purified air stream. One or more of the product streams is distributed to a plurality of vortex tubes at successively warmer temperatures so that warm and cold streams produced thereby become successively warmer and one or more of the warm streams has a temperature warmer than that of said compressed and purified air stream upon its introduction into said main heat exchanger. All but the warm stream(s) having the warmer temperature are recycled back to said main heat exchanger to participate in the indirect heat exchange and heat is rejected by discharging said warm stream(s) so that heat is rejected at the warmer temperature and refrigeration is produced.

7 Claims, 1 Drawing Sheet

FIG.
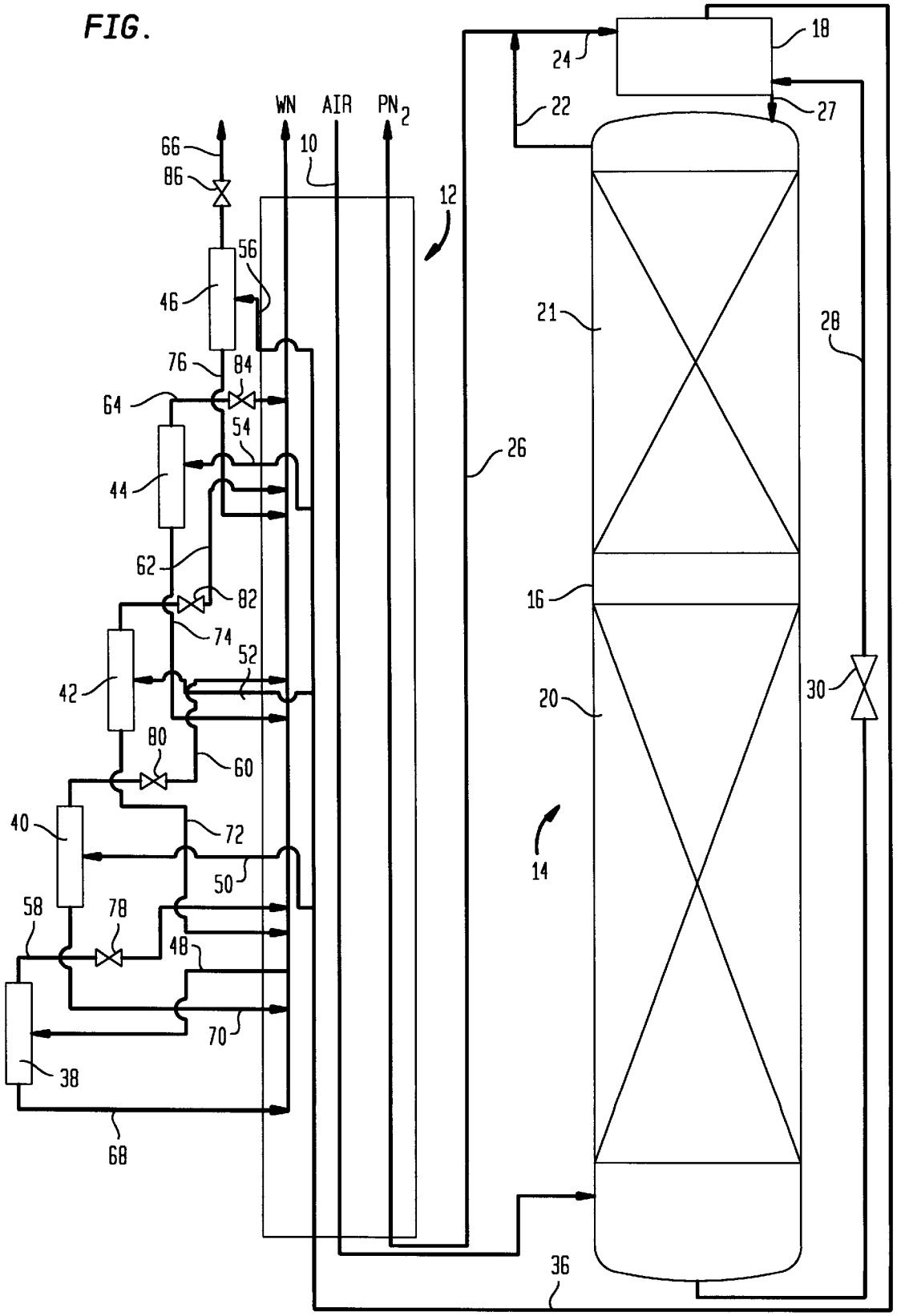

METHOD AND APPARATUS FOR SEPARATING AIR

BACKGROUND OF THE INVENTION

The present invention relates to a method and apparatus in which compressed and purified air is cooled in a main heat exchanger and is then separated in a distillation column to produce a product stream that warms within the main heat exchanger. More particularly, the present invention relates to such a method and apparatus in which one or more of the product streams is distributed to a plurality of vortex tubes operated at successively warmer temperatures so that at least one of the vortex tubes produces a warm stream at a temperature warmer than the compressed and purified air upon its introduction into the main heat exchanger to generate refrigeration.

Air is separated by a variety of well-known cryogenic rectification processes. In such processes, the air is compressed and then purified to remove moisture, carbon dioxide and hydrocarbons. The compressed and purified air is then cooled within a main heat exchanger before being introduced into a distillation column system. The distillation column system can be a single column designed to produce nitrogen as a tower overhead or one in which the air is introduced into an intermediate location thereof so that an oxygen product is also produced as a column bottoms. Another common distillation column system is a double column having higher and lower pressure columns associated with one another in a heat transfer relationship. The higher pressure column produces nitrogen as a tower overhead which is in part condensed to reflux both the higher and lower pressure columns. The column bottoms produced in the higher pressure column is introduced into the lower pressure column for further refinement to produce an oxygen product.

Since all of the systems discussed above operate at cryogenic temperatures, the main heat exchanger and distillation column system must be insulated from the environment by an external structure known as a cold box. Nevertheless, there is heat leakage through the cold box and also warm end losses due to the temperature of the incoming air. As a result, any low temperature rectification process must be refrigerated in order for the process to remain in heat balance. To this end, refrigeration is generated by expansion machines such as turboexpanders. Either part of the incoming air or vaporized liquid bottoms or nitrogen may be heated and then expanded to a low temperature. Refrigeration is generated because energy is dissipated from the system as shaft work. For instance, the turboexpander can be connected to an electrical generator or an energy dissipative oil brake.

Turboexpanders and expansion machines, however, add expense and complexity to any air separation plant. As will be discussed, the present invention provides a method and apparatus for separating air does not use expansion machines such as turboexpanders and thus, produces a simpler and more cost effective plant than has been considered in the prior art.

SUMMARY OF THE INVENTION

The present invention provides a method of separating air in which a compressed and purified air stream is cooled in a main heat exchanger. The compressed and purified air stream is then separated in a distillation column system to produce product streams. The product streams are warmed within the main heat exchanger by indirectly exchanging heat with the compressed and purified air stream. At least one of the product streams is distributed to a plurality of vortex tubes at successively warmer temperatures so that the warm and cold streams produced thereby become successively warmer and at least one of the warm streams has a temperature warmer than the compressed and purified air stream upon its introduction into the main heat exchanger. All but the at least one of the warm streams are recycled back to the main heat exchanger to participate in the indirect heat exchange. The at least one warm stream is discharged so that heat contained therein is rejected at its temperature above that of the incoming air, thereby to produce refrigeration.

In another aspect, the present invention provides an air separation apparatus including a main heat exchanger configured to cool a compressed and purified air stream by indirect heat exchange with product streams. A distillation column is connected to the main heat exchanger and is configured to separate air contained within the compressed and purified air stream, thereby to produce the product streams. A plurality of vortex tubes are connected to the main heat exchanger so that at least one of the product streams is distributed to the plurality of vortex tubes at successively warmer temperatures. Warm and cold streams produced thereby become successively warmer and at least one of the warm streams has a temperature warmer than compressed and purified air stream upon its introduction into the main heat exchanger. The plurality of the vortex tubes are connected to the main heat exchanger so that all but the at least one of the warm streams recycle back to the main heat exchanger to participate in the indirect heat exchange and the at least one of the warm streams discharges so that heat contained therein is rejected at its temperature, thereby to produce refrigeration.

It is to be noted that as used herein and in the claims, the term "distillation column system" as used herein and in the claims can be a single column designed to produce a nitrogen product or alternatively a single column to produce an oxygen product. Additionally, the term "distillation column system" also encompasses a distillation column system including higher and lower pressure columns associated with one another in a heat transfer relationship. The term "vortex tube" as used herein and in the claims means a known device, generally in the form of a tube that separates an incoming gas stream through a tangential nozzle into two streams with different stagnation temperatures. Such a device operates in accordance with the known Ranque effect. As a result, in comparison to the incoming gas, gas leaves one end of the tube at a warm temperature and at the other end, at a cold temperature.

As stated above, since a distillation process for separating air is conducted at a cryogenic temperature, there must be a compensation for heat leakage in order to keep the plant in balance. By distributing a product stream such as a vaporized oxygen enriched stream that has been used as coolant in a head condenser of a nitrogen generator, heat may be rejected at a higher temperatures than that of the incoming air. The net effect of this is to remove heat from the system and thereby to produce refrigeration by a device, namely a vortex tube, that is far less expensive than a turboexpander and has the added benefit of having no moving parts.

BRIEF DESCRIPTION OF THE DRAWINGS

While the specification concludes with claims distinctly pointing out the subject matter that Applicant regards as his invention, it is believed that the invention will be better understood when taken in connection with the sole accompanying FIGURE which is a schematic representation of an apparatus for carrying out a method in accordance with the present invention.

DETAILED DESCRIPTION

With reference to the sole FIGURE, an apparatus 1 in accordance with the present invention is illustrated. In apparatus 1 a compressed and purified air stream 10 is cooled within a main heat exchanger 12 to near its dew point temperature and is then rectified within a distillation column system 14 having a single distillation column 16 coupled to a head condenser 18 for condensing reflux.

Although not illustrated, compressed and purified air stream 10 is formed by compressing filtered air, removing the heat of compression from the air, and then purifying the air in a pre-purification unit to remove carbon dioxide, moisture and possibly also hydrocarbons. There are many known systems for effectuating such purification. Commonly, adsorbent beds operating out of phase in accordance with pressure swing adsorption and temperature swing adsorption cycles are used.

Distillation column 16 has mass transfer contacting elements such as indicated by reference numerals 20 and 21. Such mass transfer containing elements may be either structured packing, random packing or trays. Distillation column 16 produces a nitrogen rich vapor as a tower overhead and an oxygen enriched liquid as a column bottoms. The nitrogen rich tower overhead, depending on the design of the column, can be of high purity.

In order to reflux distillation column 16, nitrogen vapor stream 22 is removed and divided into a reflux stream 24 and a first product stream 26. Reflux stream 24 is condensed within head condenser 18 to produce a liquid reflux stream 27 to reflux distillation column 16. Coolant for the head condenser 18 is produced by a liquid oxygen enriched stream 28. After expansion through an expansion valve 30, liquid oxygen enriched stream 28 is vaporized within head condenser 18 to produce a second product stream 36. Second product stream 36 and first product stream 26 are introduced into main heat exchanger 12 for cooling the incoming compressed and purified air stream 10.

Second product stream 36 which consists of the vaporized oxygen enriched liquid. As second product stream 36 warms within main heat exchanger 12, it is distributed to vortex tubes 38, 40, 42, 44, and 46. This is effectuated by providing nozzles in main heat exchanger 12 to expel successively warmer subsidiary streams 48, 50, 52, 54, and 56 to vortex tubes 38, 40, 42, 44, and 46. Vortex tubes 38 through 46 inclusive produce warm streams 58, 60, 62, 64, and 66, and cold streams 68, 70, 72, 74, and 76. As can be appreciated by those skilled in the art the foregoing warm streams 58 through 66 and cold streams 68 through 76 become successively warmer as the warm end of main heat exchanger 12 is approached. Aside from warm stream 66, all of the remaining warm and cold streams 58 through 76 inclusive are recycled back to main heat exchanger 12 to help cool compressed and purified air stream 10. Valves 78, 80, 82, 84 and 86 are used to balance the warm and cold flows as contained in streams 58 through 76 inclusive.

Warm stream 66 has a temperature warmer than that of the warm end of the main heat exchanger 12 or the temperature of compressed and purified air stream 10. It is discharged from apparatus 1 to reject heat at its temperature and thereby produce refrigeration. Warm stream 66 may simply be combined at an appropriate level with second product stream 36 as waste.

Although all of the refrigeration requirements of apparatus 1 are provided by vortex tubes 38, 40, 42, 46, and 48, it is understood that for the aforementioned vortex tube arrangement might only supply part of the refrigeration requirements. The remainder of the refrigeration requirements could be provided by an external liquid source injected either directly to column 16 as additionally reflux or into head condenser 18 to increase the reflux. The advantage of such an arrangement over conventional liquid assist plant would be to conserve on the amount of liquid that was introduced into the plant. Although only vortex tube 46 produces a warm stream 66 to be discharged, a conceivable system might be to have first product stream 26 also connected to vortex tubes so that it could serve to provide refrigeration. Depending upon the particular system, proper functioning might dictate that multiple warm streams be produced by vortex tubes operating in a temperature range such that such streams would be discharged to reject heat and thus generate refrigeration.

A valve 88 can be provided to control the flow of first product stream 26. Regulation of valve 88 can be used, in an inverse manner, to regulate the flow of second product stream 36 and therefore the amount of refrigeration to be generated. At one extreme, during startup, valve 88 might be set to cut off the flow of first product stream 26 so that there was a greater flow with second product stream 36 to thereby generate more refrigeration.

The following chart is a calculated example of the present invention applied to a main heat exchanger of an air separation plant designed in accordance with apparatus 1.

| Stream No. From FIG. | Flow $SM^3/hr$ | Composition % $O_2$ | Temperature °K. | Pressure bar (a) |
|---|---|---|---|---|
| 10 | 1000 | 21 | 300 | 10 |
| 26 | 400 | 0.001 | 102.96 | 9.5 |
| 36 | 600 | 34.93 | 102.1 | 5.5 |
| 48 | 120 | 34.93 | 180.0 | 5.48 |
| 50 | 120 | 34.93 | 200.0 | 5.46 |
| 52 | 120 | 34.93 | 223.8 | 5.44 |
| 54 | 120 | 34.93 | 250.4 | 5.42 |
| 56 | 120 | 34.93 | 285.0 | 5.40 |
| 58 | 60 | 34.93 | 200.0 | 1.17 |
| 60 | 60 | 34.93 | 224.0 | 1.13 |
| 62 | 60 | 34.93 | 251.5 | 1.12 |
| 64 | 60 | 34.93 | 283.0 | 1.11 |
| 66 | 60 | 34.93 | 323.0 | 1.10 |
| 68 | 60 | 34.93 | 154.8 | 1.20 |
| 70 | 60 | 34.93 | 172.0 | 1.18 |
| 72 | 60 | 34.93 | 192.5 | 1.16 |
| 74 | 60 | 34.93 | 215.0 | 1.14 |
| 76 | 60 | 34.93 | 244.4 | 1.12 |
| 26* | 400 | 0.001 | 299.4 | 1.10 |

*At warm end of main heat exchanger 12

Vortex tubes are available commercially. As one option and for the example presented herein, the vortex tubes can be obtained from Air Research Technology Company of Cincinnati, Ohio, United States or EXAIR Corporation also of Cincinnati, Ohio, United States. Both companies publish the same performance data for their vortex tubes and the heating and cooling performance can be scaled by the absolute temperature of the inlet gas. For any particular temperature level, it is understood that best engineering practice may dictate that multiple tubes be utilized.

While the invention has been described with reference to a preferred embodiment, as will occur to those skilled in the art, numerous changes, additions and omissions may be made without departing from the spirit and scope of the present invention.

I claim:

1. A method of separating air comprising:

cooling said compressed and purified air stream within a main heat exchanger;

separating the air within the compressed and purified air stream in a distillation column system to produce product streams; and warming the product streams in said main heat exchanger by indirectly exchanging heat with said compressed and purified air stream;

distributing at least one of said product streams to a plurality of vortex tubes at successively warmer temperatures so that warm and cold streams produced thereby become successively warmer and at least one of said warm streams has a temperature warmer than that of said compressed and purified air stream upon its introduction into said main heat exchanger;

recycling all but said at least one of said warm streams back to said main heat exchanger to participate in said indirect heat exchange; and discharging said at least one warm streams so that heat contained therein is rejected at said temperature, thereby to produce refrigeration.

2. The method of claim 1, wherein all refrigeration requirements are met through said production of said refrigeration involving said vortex tubes.

3. The method of claim 1, wherein said distillation column system comprises a single column, said product streams comprise a nitrogen product stream and a vaporized oxygen-enriched stream; and said at least one of said product streams comprises said oxygen-enriched stream.

4. The method of claim 1, wherein a flow rate of said at least one of said product streams is controlled to in turn regulate the production of refrigeration.

5. An air separation apparatus comprising:

a main heat exchanger configured to cool a compressed and purified air stream by indirect heat exchange with product streams;

a distillation column system connected to said main heat exchanger and configured to separate the air within the compressed and purified air stream, thereby to produce product streams; and a plurality of vortex tubes connected to the main heat exchanger so that at least one of said product streams is distributed to said plurality of vortex tubes at successively warmer temperatures, warm and cold streams produced thereby become successively warmer, and at least one of the warm streams has a temperature warmer than that of said compressed and purified air stream upon its introduction into said main heat exchanger;

the plurality of vortex tubes also being connected to said main heat exchanger so that all but said at least one of the warm streams recycle back to said main heat exchanger to participate in said indirect heat exchange and said at least one of the warm streams discharges so that heat contained therein is rejected at said temperature, thereby to produce refrigeration.

6. The air separation apparatus of claim 5, wherein said distillation column system includes a single column system configured to produce a nitrogen product stream and an oxygen enriched stream and said at least one product stream comprises said oxygen enriched stream.

7. The air separation apparatus of claim 5, further comprising a valve positioned to control the flow of said at least one of said product streams, thereby to regulate refrigeration production.

* * * * *